United States Patent [19]

Wheeler

[11] Patent Number: 4,508,154

[45] **Date of Patent: * Apr. 2, 1985**

[54] WINDOW CASEMENT

[76] Inventor: Everett T. Wheeler, 293 Mt. Vernon St., Lawrence, Mass. 01843

[ * ] Notice: The portion of the term of this patent subsequent to May 4, 1999 has been disclaimed.

[21] Appl. No.: 557,328

[22] Filed: Dec. 2, 1983

[51] Int. Cl.[3] ..... E06B 3/32

[52] U.S. Cl. ..... 160/98; 160/107

[58] Field of Search ..... 160/37, 87, 88, 89, 160/98, 107, 108, 236; 49/64, 65

[56] References Cited

U.S. PATENT DOCUMENTS

| | | | |
|---|---|---|---|
| 1,639,474 | 8/1927 | Whitmore | 160/236 |
| 2,155,985 | 4/1939 | Waterman | 160/236 |
| 2,170,777 | 8/1939 | Simon | 160/107 |
| 2,227,238 | 12/1940 | Warren | 160/89 |
| 2,355,803 | 8/1944 | Hopewell | 160/37 |
| 2,490,295 | 12/1949 | Fisher | 160/107 |
| 2,560,397 | 7/1951 | Tims | 160/98 |
| 2,651,085 | 9/1953 | Kopp | 49/64 |
| 2,855,039 | 10/1958 | Gross | 160/236 |
| 3,089,540 | 5/1963 | Schwartz | 160/98 |
| 3,292,309 | 12/1966 | Horner | 49/64 |
| 4,060,119 | 11/1977 | Nohmura et al. | 160/88 |
| 4,327,795 | 5/1982 | Wheeler | 160/98 |

*Primary Examiner*—Peter M. Caun

*Attorney, Agent, or Firm*—Robert T. Gammons

[57] ABSTRACT

A window casement defining a window structured to be permanently installed in a wall opening within the wall studding defining a chamber closed except for narrow openings at the top and bottom which have communication with the interior of the building within which it is installed and containing heat absorbing and heat transmitting elements which may be positioned to on the one hand absorb heat and on the other hand to reflect heat and wherein said elements can be partially or wholly withdrawn from the chamber to permit an unobstructed view through the window opening.

16 Claims, 12 Drawing Figures

WINDOW CASEMENT

BACKGROUND OF THE INVENTION

In my U.S. Pat. No. 4,327,795 of May 4, 1982, there is disclosed a window casement designed to be attached to a window frame outside the window sash which is operative on the one hand to serve as a storm window and on the other hand to provide supplemental heat during the winter and cooling during the summer. The casement is hingedly supported at its top to the outer side of the window frame and is provided with means for moving it from a position parallel to the window to a position displaced angularly away from the window frame. The casement defines a closed chamber, except for narrow openings at the top and bottom which provide communication with the interior of the building when the casement is disposed parallel to the window frame and the window is open. There are horizontally hung slats within the casement chamber provided on one side with heat absorbent surfaces and on the other side with heat reflective surfaces. These slats are hung so that they may be rotated about their transverse axes to on the one hand dispose the absorbent surfaces to light entering the casement and on the other hand to dispose the heat reflective surfaces to the light entering the casement. The casement of the instant invention is designed to be a permanent installation in place of the conventional window casement, rather than to be hingedly attached thereto as shown in the aforesaid patent and, optionally, to provide horizontal slats and/or a pull down curtain as shown in the aforesaid patent or vertically hung slats and/or a vertically hung draw drape which can be moved transversely into a storage chamber at one side of the window casement. The vertically hung slats and vertically hung draw drape, as with the horizontally hung slats and pull down curtain shown in the aforesaid patent, have on one side heat-absorbent surfaces and on the other side heat-reflective surfaces.

SUMMARY OF THE INVENTION

As is herein illustrated, the window casement is structured to be set into a wall opening and to be permanently attached to the studding peripherally of the opening and comprises a frame defined by rectangularly-arranged, spaced, parallel top, bottom and side members, spaced, parallel front and back panels mounted in said frame defining with the top, bottom and side members a closed chamber, said front and back panels being light-transmitting and said back panel containing at the top and bottom narrow, transversely-arranged openings providing communication with the interior of the building within which the casement is installed, and means within the chamber for on the one hand absorbing heat from light entering the front panel and transmitting it through said narrow openings into the buildings and on the other hand to reflect heat entering the front panel. Desirably, there are vents at the top and bottom of the front panel to admit air to the chamber from the outside. The means for on the one hand absorbing heat and on the other hand reflecting heat comprise in one form horizontally hung, vertical, spaced slats arranged to be rotated about their horizontal axes to provide an opening therebetween or to have overlapping engagement, having on their opposite sides heat-absorbing material and heat-reflective material. The slats may embody hollow, perforate tubes for dissipating heat or imperforate tubes for receiving heat-absorbent material. Optionally, the slats may be replaced by a pull down curtain, one side of which is an absorbent material and the other side of which is a reflective material. In another form, the means for on the one hand absorbing heat and on the other hand reflecting heat comprise transversely-spaced, narrow, vertically hung slats arranged to rotate about their vertical axes to provide on the one hand open spaces between the slats and on the other hand to have overlapping engagement with each other to block passage of light, wherein the slats have on one side heat-absorbent surfaces and the other side heat-reflecting surfaces. The slats may embody hollow, perforate tubes for dissipating heat and/or imperforate tubes for receiving heat-absorbent material. Optionally, a draw drape may be substituted for the vertically hung slats provided on one side with an absorbent surface and on the other side with a reflective surface. The casement may include a lateral extension defining a storage chamber at one side thereof and the horizontal or vertical slats and the rolled curtain or draw drapes can be supported within the casement for withdrawal therefrom into the storage chamber. This may be done with traverse rods or a rigid frame mounted in the casement on tracks which extend into the storage chamber. Desirably, the back panel of the casement is hingedly connected to the frame for movement from a position parallel to the front panel to a position at an angle thereto to provide access to the chamber.

The invention will now be described in greater detail with reference to the accompanying drawings, wherein.

Figure 1:
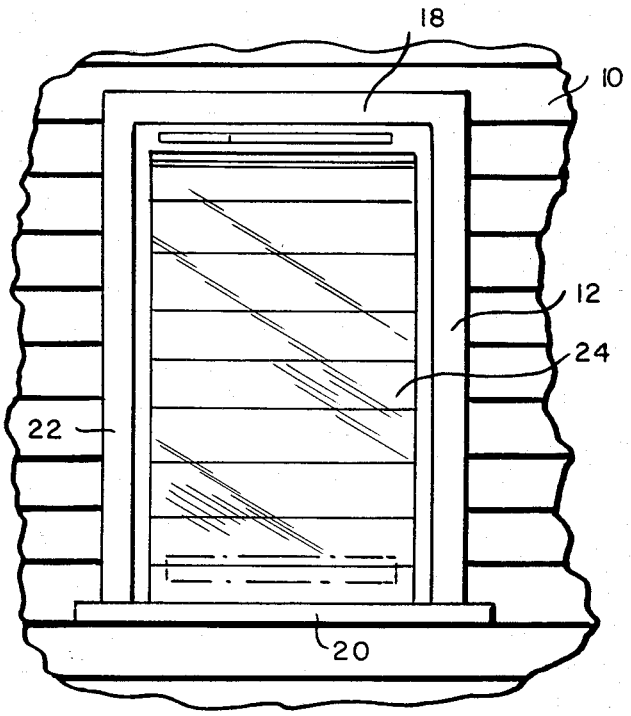
FIG. 1 is an elevation of a portion of a building within which the window casement of this invention is installed.
Figure 2:
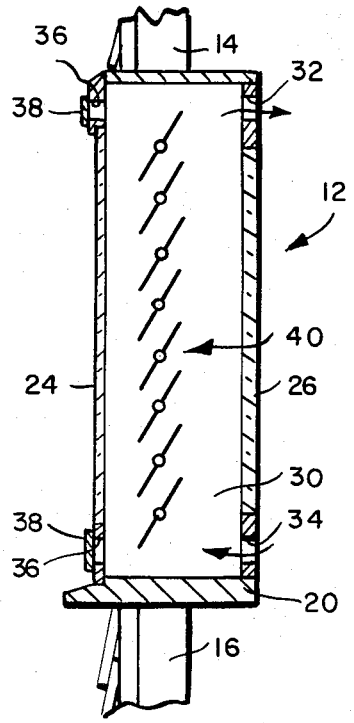
FIG. 2 is a vertical section taken on line 2—2 of FIG. 1 wherein the heat-absorbent and reflective means are in the form of horizontally hung slats.

Referring to the drawings, FIGS. 1 and 2, there is shown a portion of a building 10 in which there is installed the window casement 12. The casement 12 in one form is supported within the usual wall studding indicated at 14 and 16 of FIG. 2 and comprises a rectangular frame 16 defined by spaced, parallel top and bottom frame members 18 and 20, side frame members 22—22 and front and back light-transmitting panels 24 and 26. The frame members 18, 20 and 22—22 are conventionally comprised of wood, although they could be comprised of aluminum or some other suitable structural material. The frame members may be light-transmitting or non-light-transmitting. The front and back panels 24 and 26 may be wholly or partially transparent or translucent and may be comprised of glass or some substitute therefor such as sheet plastic.

The top, bottom, sides, front and back members define a rectangular chamber 30 which is for the most part closed, except for narrow, horizontally-disposed slots or openings 32 and 34 at the top and bottom of the rear wall 26 which provides communication between the chamber 30 and the interior of the building. Optionally, there may also be provided a narrow, horizontally-positioned slot 36 at the top and bottom of the front member over which there is positioned a vent plate 38 which may be positioned to completely close the slot 36 or to partially open it.

Within the chamber 30, there is supported means for on the one hand absorbing heat from light entering through the front member 24 and on the other hand reflecting heat from the light entering the front member 24. As herein illustrated, in one form this means comprises a plurality of horizontally-hung slats 40 of the kind such as are employed in the manufacture of venetian blinds suspended so that they can be moved to the top of the chamber or extended from the top to the bottom and for rotation about their horizontal axes to dispose them in positions to provide spaces between slats or to close the spaces between slats. The slats 40 have on one side heat absorbent material 42 and on the other side heat reflective material 44. When the slats are extended, they can be positioned to absorb heat from light entering the front member 24 or to reflect heat entering through the front member 24.

The chamber 30 as thus constructed is capable of generating heat when the slats are disposed with their heat absorbent surfaces in a position to receive light through the front member 24 and to set up convection flow of warm air which will rise within the chamber, pass through the opening 32 at the top into the building while, at the same time, cool air is withdrawn through the opening 34 at the bottom into the chamber for heating. On the other hand, for cooling purposes, the slats are disposed with their reflective surfaces facing the front member 24 to minimize the flow of warm air from the chamber into the building. To augment the cooling effect, the vent plate 38 may be open to allow outside air to enter the building.

Figure 6:
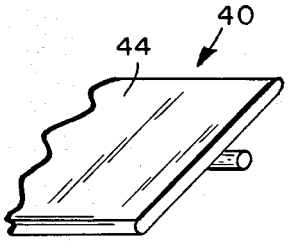
FIG. 6 is a fragmentary perspective of a slat having on one side a reflective surface.
Figure 7:
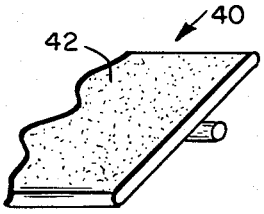
FIG. 7 is a fragmentary perspective of a slat having on one side an absorbent surface.
Figure 8:
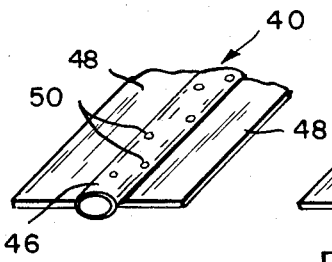
FIG. 8 is a perspective of a fragmentary portion of a slat provided with a perforated tube for dissipating heat.
Figure 9:
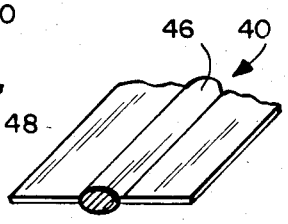
FIG. 9 is a perspective of a slat with an imperforate tube for receiving a heat-absorbent material.

The slats 40, fragmentary portions of which are shown in perspective in FIGS. 6 and 7, have, as previously described, on one side absorbent surfaces 42 and on the other side reflective surfaces 44. Optionally, the slats may be structured as shown in FIG. 8 in the form of tubes 46 having diametrically-arranged fins 48—48. In one form, the tubes 46 contain perforations 50 for dissipation of heat. In another form the tubes 46 may be imperforated and contain heat absorbent material.

Figure 10:
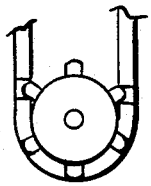
FIG. 10 is a fragmentary view showing chain and sprocket means for rotating the slats, whether horizontally or vertically disposed.
Figure 11:
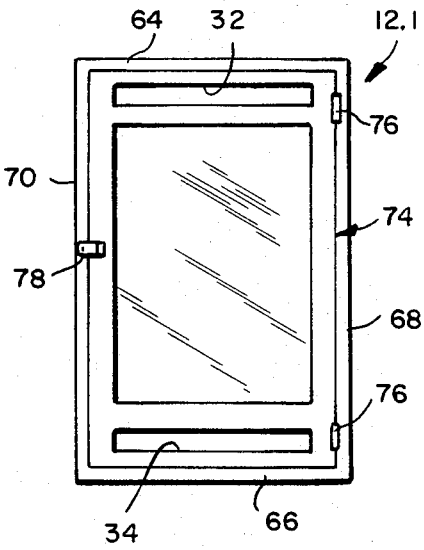
FIG. 11 is a rear elevation of the casement showing the rear panel hinged to provide access to the chamber.

FIG. 10 shows a conventional chain and sprocket means for reversing the position of the slats.

Figure 3:
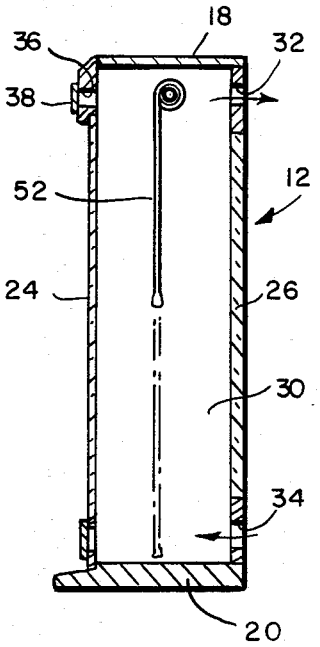
FIG. 3 is a section like FIG. 2 with a pull down curtain substituted for the slats shown in FIG. 2.
Figure 4:
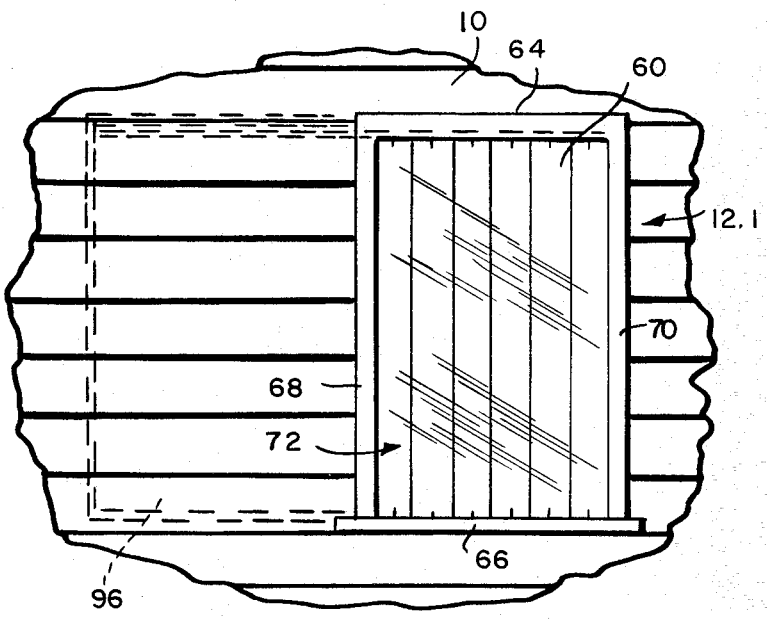
FIG. 4 is an elevation of a window casment provided with a storage chamber at one side for receiving vertically hung slats.
Figure 5:
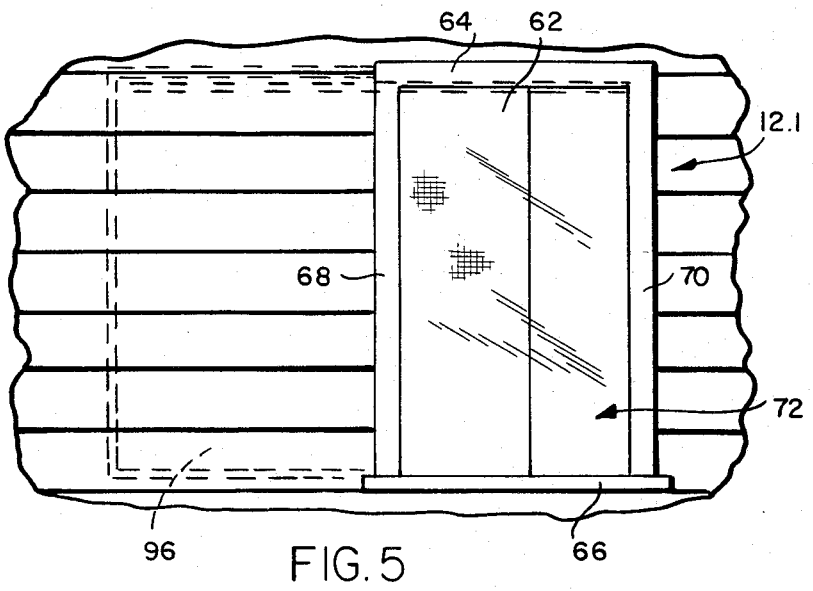
FIG. 5 is an elevation like FIG. 4 with a draw drape substituted for the slats.

A conventional pull-down roller curtain 52, FIG. 3, may be substituted for the slats, one side of which is coated with a heat absorbent material and the other side of which is coated with a reflective material.

An alternative casement 12.1 is shown in for receiving vertically hung slats 60 or a vertically hung draw drape 62 in place of the horizontal slats or pull-down curtain as described above. The casement 12.1 as previously described comprises top and bottom frame members 64 and 66, side frame members 68 and 70 and front and back light transmitting panels 72 and 74. The frame members may be comprised of wood or aluminum or some other suitable material and the front and back light transmitting panels may be glass or plastic or may be wholly or partially transparent. The vertically hung slats 60 are supported for rotation about their vertical axes to provide openings between adjacent slats or to close the openings between adjacent slats and these slats have on one surface heat absorbent surfaces and on the other surface heat reflective surfaces. In this form of the invention, a storage chamber 96 is installed within the wall structure at one side of the casement 12.1 and an opening is provided in the side frame member 68 so that the slats can be drawn laterally from the chamber provided by the casement into the storage chamber 96 for storage. Suitable traverse rods are mounted at the top of the casement and at the top of the storage chamber to enable drawing the slats laterally into the storage chamber. Instead of slats 60, a curtain 62 in the form of a draw drape may be suspended at the top of the casement on a traverse rod for movement from the casement into the storage chamber. The draw drape will have one surface comprised of a heat-absorbent material and the other surface comprised of a heat-reflective material.

It is within the scope of the invention to provide a storage chamber at each side of the window casement so that half of the slats can be drawn into the chamber at one side and the other half into the chamber at the other side.

As previously described with reference to the invention shown in FIGS. 1 and 2, the casement 12.1 has openings at the top and bottom for permitting circulation of air from the casement chamber into the building and vent openings at the top and bottom of the front member 72 for admitting outside air when desired.

Figure 12:
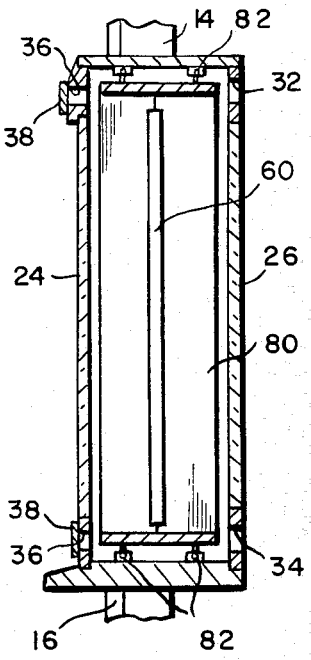
FIG. 12 is a vertical section showing a rigid frame mounted within the casement shown in FIG. 4 for supporting the slats, whether horizontal or vertical, and/or the roller curtain or draw drape for lateral movement from the casement into the storage chamber shown in FIGS. 4 and 5.

FIG. 12 illustrates the use of a transversely-movable frame 80 mounted in the casement on transversely-extending tracks 82—82 at the top and bottom which extend into the storage chamber for supporting the slats, whether horizontal or vertical, and/or a roller curtain or draw drapes for movement from the casing into the storage chamber.

Desirably, the back panel 26 of the casement 12 and the back panel 74 of the casement is hingedly connected to one side to the side member at that side to provide for access to the chamber 30 for cleaning and/or manipulation of the slats and/or curtains or drapes by means of conventional draw cords. Hinges 76—76 and a latch 78 secure the back panel 74.

It should be understood that the present disclosure is for the purpose of illustration only and includes all modifications or improvements which fall within the scope of the appended claims.

What is claimed is:

1. A window casement, structured to be set into a wall opening and to be permanently attached to the studding peripherally of the opening comprising a frame defined by rectangularly arranged space parallel top, bottom and side members, spaced parallel front and back panels mounted in said frame defining with the top, bottom and side members a closed chamber, said front and back panels being light transmitting and said back panel containing at the top and bottom narrow transversely arranged openings providing communication with the interior of the building within which the casing is installed and means within the chamber for one the one hand absorbing heat from light entering the front panel, and transmitting it throught said narrow openings into the building and on the other hand to reflect heat entering the front panel.

2. A window casement according to claim 1 wherein the front panel has at the top a vent which on the one hand can be closed and on the other hand can be opened.

3. A window casement according to claim 1 wherein said means are horizontally hung, vertically spaced slats arranged to be rotated about their horizontal axes to provide on the one hand open spaces between slats and on the other hand overlapping engagement with each other and wherein said slats have on one side heat absorbent surfaces and on the other side reflective surfaces.

4. A window casement according to claim 1 wherein the slats define hollow tubes for receiving heat absorbent material.

5. A window casement according to claim 1 wherein the slats define hollow tubes containing perforations to dissipate the heat.

6. A window casement according to claim 3 wherein the slats can be raised within the chamber to substantially the top to afford unobstructed entry of light through the casement.

7. A window casement according to claim 1 wherein the means are vertically hung, transversely spaced parallel slats arranged to be rotated about their vertical axes to provide on the one hand open spaces between slats and on the other hand to have overlapping engagement with each other to block passage of light and wherein said slats have on one side heat absorbing surfaces and on the other side heat reflecting surfaces.

8. A window casement according to claim 7 wherein said slats define hollow tubes for receiving heat absorbent material.

9. A window casement according to claim 7 wherein the slats define hollow tubes which contain perforations.

10. A window casement according to claim 7 wherein the casement includes a lateral extension defining a storage chamber at one side of the casement and the slats are hung to enable withdrawing them from the casement into the storage chamber to provide unobstructed entry of the light through the window casement.

11. A window casement according to claim 10 wherein the casement includes lateral extensions at both sides of the window opening defining storage chambers for the slats and the slats are hung to enable withdrawing slats from the window opening into the storage chambers for storage to permit unobstructed entry of light through the window casement.

12. A window casement according to claim 1 wherein the means comprise a pull-down curtain supported at the top of the chamber which may be drawn down to partially or completely cover the window opening and wherein said curtain has at one side an absorbent surface and at the other side a reflective surface.

13. A window casement according to claim 1 wherein the casement includes a lateral extension defining a storage chamber and the means comprises a draw drape suspended in the chamber for movement transversely into the storage chamber to on the one hand cover the window opening and on the other hand to clear the window opening and wherein the draw drape has at one side an absorbent surface and on the other side a reflective surface.

14. A window casement according to claim 1 wherein the back panel is hingedly connected to the frame for movement from a position parallel to the front panel to a position at an angle thereto to provide access to the chamber.

15. A window casement according to claim 1 wherein there is a storage chamber at one side of the casement and means within the casement supporting the means for absorbing and/or reflecting heat for movement from the casement into the storage chamber.

16. A window casement according to claim 15 wherein the first means is a rigid frame and tracks supporting the rigid frame for movement laterally from the casement into the storage chamber.

* * * * *